United States Patent [19]

Bernabe, Jr.

[11] Patent Number: 4,483,447

[45] Date of Patent: Nov. 20, 1984

[54] SAFETY MOUNTING FOR SIDE STOWABLE BOOM EXTENSION OR JIB

[75] Inventor: Vincent Bernabe, Jr., Newville, Pa.

[73] Assignee: Kidde, Inc., Saddle Brook, N.J.

[21] Appl. No.: 382,203

[22] Filed: May 26, 1982

[51] Int. Cl.[3] ..... B66C 23/66

[52] U.S. Cl. ..... 212/188; 212/177; 403/102

[58] Field of Search ..... 212/177, 187, 188, 266; 403/91, 92, 102; 52/115, 116, 117

[56] References Cited

U.S. PATENT DOCUMENTS

| | | | |
|---|---|---|---|
| 3,785,505 | 1/1974 | Keller | 212/177 |
| 3,944,082 | 3/1976 | Fritsch | 212/187 |
| 4,141,455 | 2/1979 | Henderson et al. | 212/188 |
| 4,222,492 | 9/1980 | Wuerflein et al. | 212/188 |
| 4,303,165 | 12/1981 | Cassens et al. | 212/188 |
| 4,318,488 | 3/1982 | Rathi | 212/177 |

FOREIGN PATENT DOCUMENTS

| | | | |
|---|---|---|---|
| 3037924 | 6/1981 | Fed. Rep. of Germany | 212/188 |

*Primary Examiner*—Trygve M. Blix
*Assistant Examiner*—Thomas J. Brahan
*Attorney, Agent, or Firm*—Brady, O'Boyle & Gates

[57] ABSTRACT

A swing-around side stowable jib for crane booms is safely supported at all times during movement from its use position to its stowed position, and vice versa. In the short transitional movement of the jib following its release from its nose assembly pivot and immediately prior to re-engaging this pivot, the jib is always securely held by a strongly biased safety latch in supportive engagement with a side mounting assembly located between the nose assembly pivot and a second mounting assembly on the boom rearwardly of the first mounting assembly. The safety latch at proper times is easily released by operation of a hand lever near ground level. Locks for the safety latch and its release lever are also provided. The safety latch is swiveled and biased to meet the swing-around jib squarely as it approaches the stowed position.

13 Claims, 11 Drawing Figures

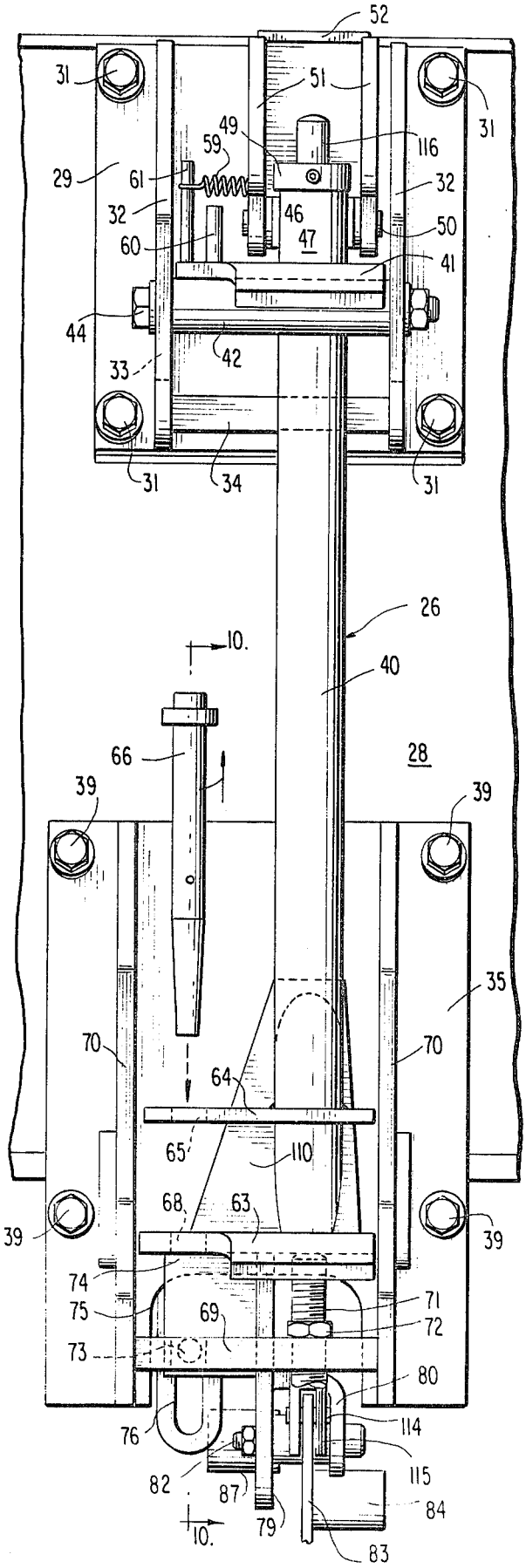
FIG.6
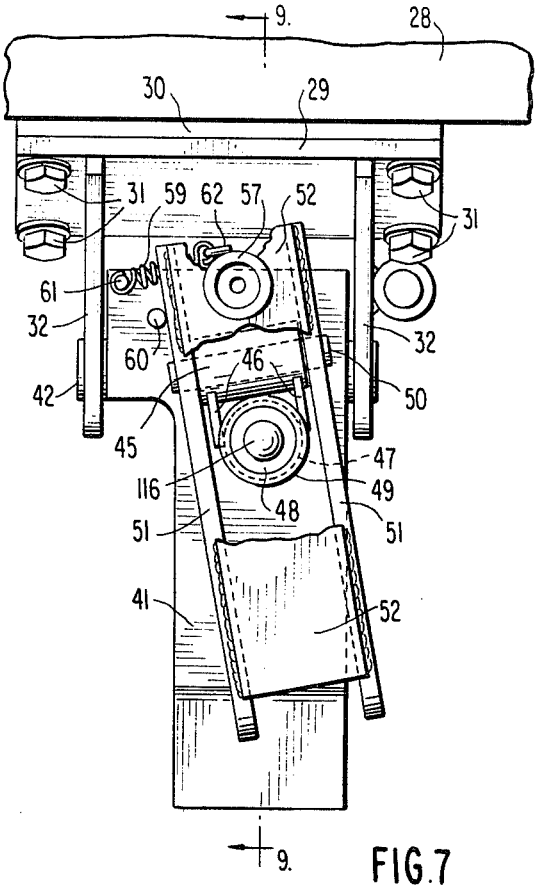
FIG.7
FIG.8
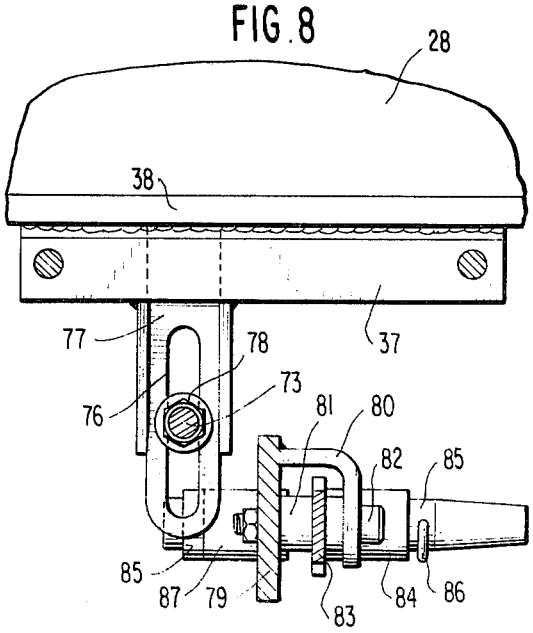

SAFETY MOUNTING FOR SIDE STOWABLE BOOM EXTENSION OR JIB

BACKGROUND OF THE INVENTION

U.S. Pat. No. 3,785,505 discloses a side stowable jib for crane booms in which spaced front and rear mounting brackets for the stowed jib are provided on one side of a telescoping boom base section. Another mount for the boom jib or extension is provided on the nose assembly of the boom fly section. The jib, when being swung around from its use position to its side stowed position, rotates on a releasable pivotal connection with the nose assembly and following engagement of the jib with the forward mounting bracket and the placement of jib retainer pins in such bracket, the nose assembly pivotal connection is released to permit final swinging of the jib into supportive engagement with the rear mounting bracket.

A major objective of this invention is to improve on the safety of this prior art arrangement. An unsafe situation can develop with the arrangement in the aforementioned patent if the nose assembly pivot for the jib should be disconnected before locking pins are placed in the front mounting bracket. In such a case, the jib could slip and fall from the front mounting bracket while it is being brought into engagement with the rear mounting bracket on the adjacent side of the boom.

The present invention completely eliminates this unsafe possibility through provision on the forward mounting bracket or assembly of a biased latch which is always engaged and operated by contact with the jib when the latter first swings into engagement with the forward mounting assembly. When the nose assembly pivot is disconnected immediately following such engagement, the safety latch assures that the jib is safely supported during the final transitional movement into supportive engagement with its rear mounting assembly on the boom. In the reverse situation, when the jib is being swung around from its side stowed position to its extended use position, it is always safely held in the forward mounting assembly until the pivotal connection with the nose assembly of the boom is re-established, including during the critical transition period between the release of the jib from the rear mounting assembly and its reconnection with the nose assembly.

After the safe reconnection of the base of the jib with the nose assembly, the biased safety latch of the first mounting assembly is released by operation of a release lever on the first mounting assembly which can be reached from ground level.

Other meritorious features of the present invention will appear to those skilled in the art during the course of the following description.

BRIEF DESCRIPTION OF THE DRAWINGS

FIG. 6 is a fragmentary side elevation of components shown in FIG. 4, the safety latch in this figure being shown in the raised position corresponding to the broken line illustration in FIG. 4.

FIG. 7 is a fragmentary plan view showing the safety latch and associated elements of the forward mounting assembly.

FIG. 8 is a fragmentary vertical section taken on line 8—8 of FIG. 4.

DETAILED DESCRIPTION

Figure 1:
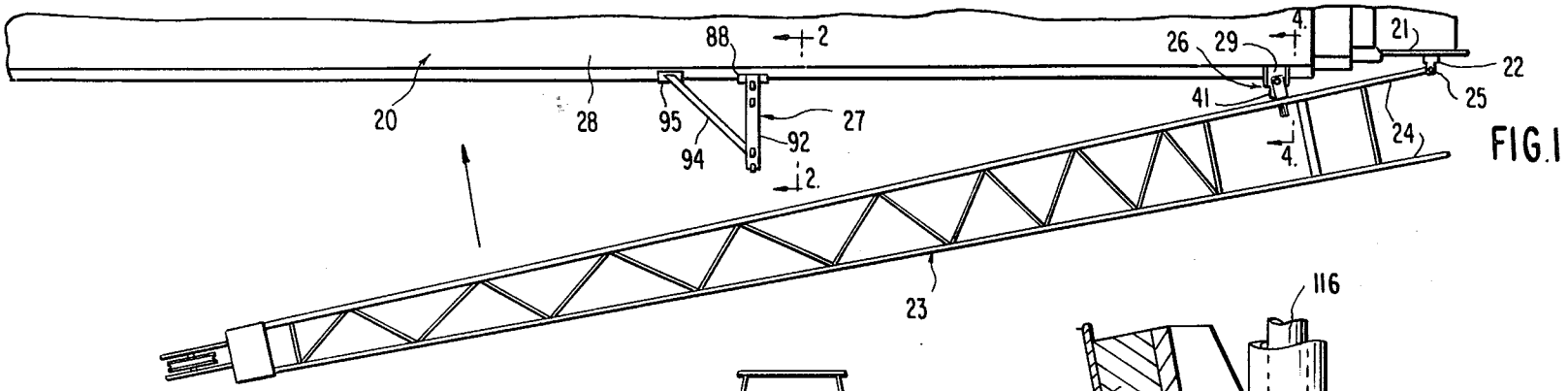
FIG. 1 is a fragmentary plan view showing a telescoping crane boom and a side stowable extension or jib for such boom in the process of being swung around to its stowed position.

Referring to the drawings in detail wherein like numerals designate like parts, a multi-section telescoping crane boom 20 includes a nose assembly 21 on its fly section having a side support element 22 for the base of a side stowable extension or jib 23. Another support element 22, not shown, is present on the far side of the nose assembly 21. Inasmuch as the jib 23 is of the truss type including four corner struts 24, the support elements 22 on opposite sides of the nose assembly 21 are provided in pairs, as shown in the prior art. The struts 24 at each side of the jib 23 at the base of the jib are attached to the support elements 22 by releasable pivot elements 25, such as pins, which engage through registering apertures of the struts 24 and support elements 22.

When the jib 23 is in the forwardly extending use position, not shown in the drawings, the base ends of all of its struts 24 are securely connected through the elements 25 with the support elements 22 on both sides of nose assembly 21. When it is desired to stow the jib along one side of the boom 20 as depicted in FIG. 1, the elements 25, not shown, at the far side of nose assembly 21 are released, and the jib is swung around on the axes of the remaining pivot elements 25 toward its side stowed position as shown by the arrow in FIG. 1.

As stated previously, the present invention is concerned primarily with safer manipulation of the heavy jib 23 during its swinging movement from its use position to its stowed position, and vice versa. In accomplishing this end, a front mounting assembly 26 and a rear mounting assembly 27 are provided in spaced relationship on one side of the base section 28 of crane boom 20. The principal subject matter of the invention is embodied in the front mounting assembly 26, as will soon be apparent.

Figures 4, 5:
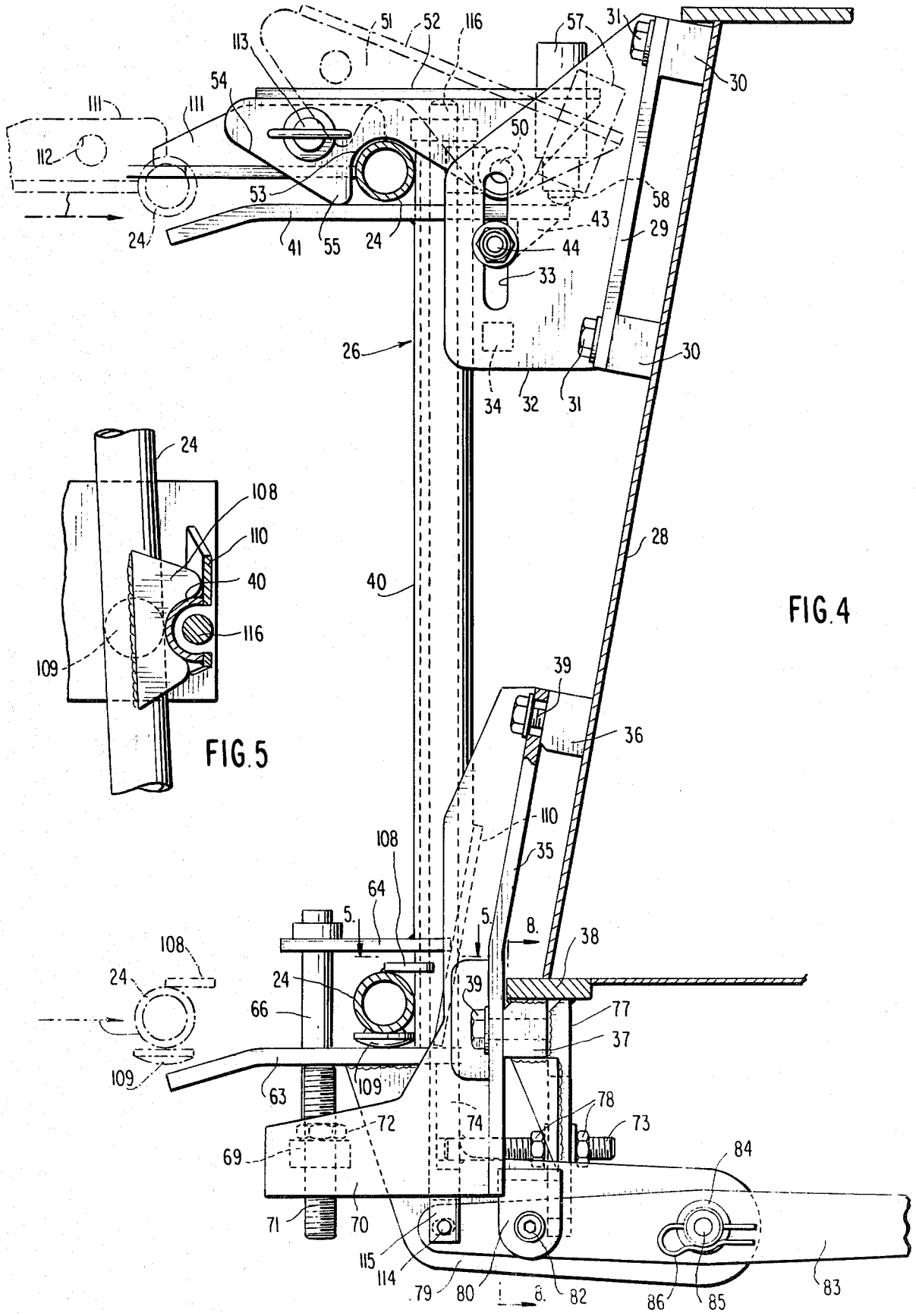
FIG. 4 is an enlarged fragmentary vertical section taken on line 4—4 of FIG. 1.
FIG. 5 is a fragmentary horizontal section taken on line 5—5 of FIG. 4.

The details of front mounting assembly 26 are shown in FIGS. 4 and 6 and comprise an upper mounting bracket 29 suitably spaced from the side wall of boom section 28 by fixed stand-off blocks 30. The bracket 29 is firmly anchored to the adjacent boom section by bolts 31 and includes a pair of spaced parallel projecting plates 32 having vertical adjustment slots 33 formed therein. Near their lower ends, the plates 32 are interconnected by a brace 34 for added strength.

The front mounting assembly 26 further comprises a lower mounting bracket 35 positioned relative to boom section 28 by an upper stand-off block 36 and a lower block 37 welded to the bottom of a lower corner plate 38 of boom section 28. The bracket 35 is anchored to the blocks 36 and 37 by bolts 39.

Extending between the two fixed mounting brackets 29 and 35 is a vertical tube 40 whose upper end is welded to a horizontal ramp plate 41 projecting outwardly from the adjacent side wall of the boom. To the inner side of the tube 40 immediately below ramp plate 41 is welded a sleeve 42 reinforced by gusset plates 43 connected with the bottom of ramp plate 41. This sleeve receives a horizontal axis adjusting bolt 44 which also passes through the vertical adjusting slots 33 of plates 32.

Above ramp plate 41 a parallel axis sleeve 45 is welded to recessed support plates 46 fixed to opposite sides of a vertical axis rotatable sleeve 47 which surrounds a coaxial intermediate sleeve 48, the latter being welded within an opening of ramp plate 41. A collar 49 on the intermediate sleeve 48 above rotational sleeve 47 prevents upward movement of the sleeve 47. The collar 49 is held by a set screw, as shown.

The sleeve 45 receives therethrough across the axis of rotary sleeve 47 a pivot pin 50 which extends through aligned apertures in the side walls 51 of a pivoted safety latch forming an important element of the invention. The safety latch is pivoted on the axis of pin 50 for vertical swinging movement between the horizontal latching position shown in full lines in FIG. 4 and in FIG. 9 and an elevated inclined release position shown in broken lines in FIG. 4 and also shown in FIG. 6. The pivoted safety latch includes a top wall 52. Forwardly of pivot pin 50 and vertical tube 40, latch side walls 51 are provided with arcuate latching recesses 53 which can receive and lock the interior side upper strut 24 of jib 23 at proper times. Forwardly of recesses 53, latch side walls 51 have sloping lower edges 54 for camming engagement with the strut 24 as the latter swings into engagement with the safety latch in its movement toward the side stowed position.

The safety latch is strongly biased on its pivot 50 toward the horizontal full line locking position shown in FIG. 4 where the lower terminals 55 of sloping edges 54 are against the ramp plate 41. This biasing of the safety latch is provided by a strong compression spring 56 retained in a vertical axis spring cartridge sleeve 57 and acting downwardly on a plunger 58 in this sleeve whose lower rounded end bears on the rear end of ramp plate 41 at a point rearwardly of pivot pin 50. The reaction through the spring biases the pivoted safety latch counterclockwise on pivot pin 50, FIG. 9, to the position shown therein and shown in full line in FIG. 4.

The latch is also turnable with the sleeve 47 around the axis of tube 40. It may be seen that a form of gimbal for the safety latch is provided. As shown in FIG. 7, the latch is biased by a spring 59 toward an angled position out of parallelism with the underlying ramp plate 41. In such position, the latch engages a stop pin 60 carried by the rear end portion of ramp plate 41. The spring is connected between a post 61 on the ramp plate and an element 62 on the rear side of cartridge sleeve 57. The purpose of this arrangement is to insure that in swinging to its stowed position, FIG. 1, the strut or bar 24 of the jib will engage the safety latch at right angles to its longitudinal axis, that is to say, the axis of the strut 24 will be squarely across the axis of the latch when the strut first begins to contact the sloping faces 54 of the latch. Between this time and the time when the jib is in the final stowed position fully engaged with both mounting assemblies 26 and 27, the latch will gradually turn and adjust itself into parallelism with the ramp plate 41 while remaining at all times in a perpendicular relationship to the strut 24.

The lower end of vertical tube 40 is fixed to and terminates at a lower ramp plate 63 parallel to ramp plate 41. Above the ramp plate 63 in parallel relationship thereto is a locking plate 64 having a locking pin aperture 65 to receive a removable vertical locking pin 66 at proper times having a retainer 67. The underlying ramp plate 63 is also apertured at 68 to receive the pin 66 and the lower end of this pin extends through an aperture in a bar member 69 fixed rigidly between a pair of spaced parallel vertical webs 70 on lower bracket 35.

A vertical adjusting screw 71 having its top end engaging the bottom of ramp plate 63 carries a nut 72 above and engaging the bar 69. A horizontal axis adjusting screw 73 is welded in a threaded opening of a vertical plate 74 and projects inwardly thereof, the plate 74 being welded to the bottom of ramp plate 63. The screw 73 passes through a slot 75 in the lower end of bracket 35 and then through a vertical adjustment slot 76 in a vertical plate 77 welded to and depending from the plate 38. The screw 73 carries adjusting and locking nuts 78 on opposite sides of plate 77.

Figure 1A:
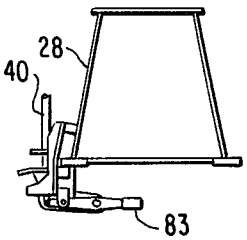
FIG. 1*a* is a front elevational view of the boom on a greatly reduced scale showing a latch release lever, parts omitted.
Figure 10:
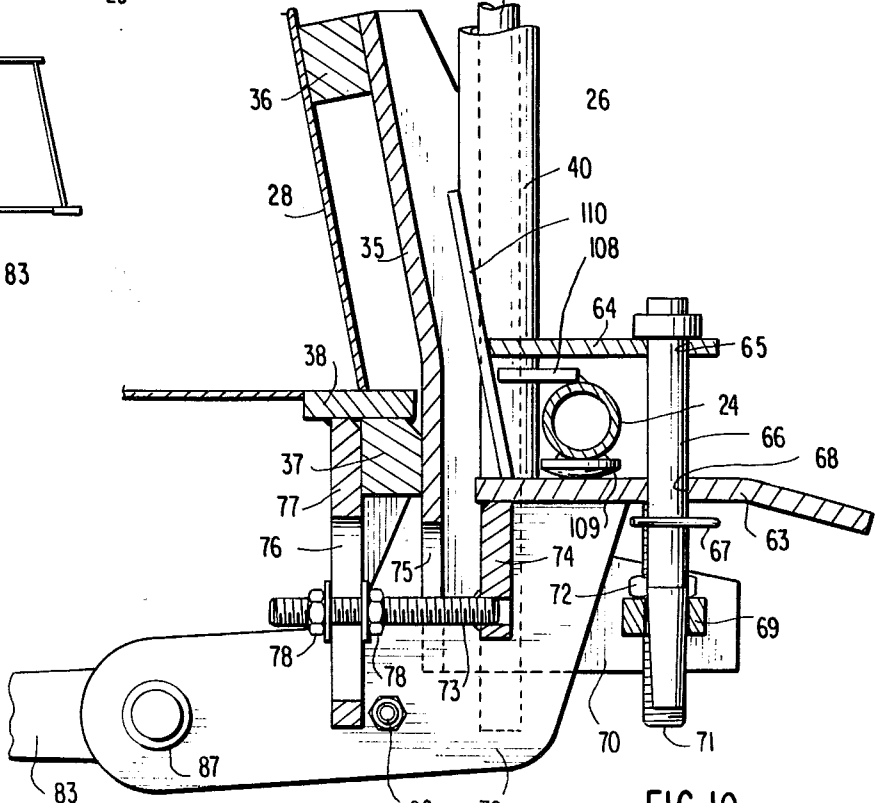
FIG. 10 is a fragmentary vertical section taken on line 10—10 of FIG. 6.

A vertical support plate 79 has its top welded to the bottom of ramp plate 63 and projects somewhat inwardly beneath boom section 28, FIG. 4. A bracket 80 welded to one side of plate 79 extends in spaced parallel relation to such plate and a latch release lever pivot bushing 81 is disposed between the plate and bracket and receives therethrough a pivot bolt 82 which is supported by the plate 79 and bracket 80. A horizontal safety latch release lever 83 having a handle, FIG. 1*a*, is secured to the bushing 81 and rotates on the axis of bolt 82 at proper times. Inwardly of its pivot axis, the lever 83 has secured to one side thereof a lock pin support bushing 84 which receives at proper times a removable lever lock pin 85 having a retainer 86. A coaxial bushing 87 fixed to the vertical plate 79 becomes aligned with the lever bushing 84 when the lever 83 is in the position to be locked, FIGS. 4 and 8. In such position, the bushing 87 also receives the removable locking pin 85 for solidly locking the lever 83.

It can now be understood that a sub-assembly of components on the two mounting brackets 29 and 30 can be adjusted as a unit in two planes and pivoted somewhat to assure proper alignment of the front mounting assembly 26 with the swing-around jib 23, and in particular its two inner side struts 24. This adjustable sub-assembly includes the tube 40 and all of the described parts connected to it including safety latch 51 and latch release lever 83. More particularly, the entire sub-assembly can be adjusted vertically along slot 33 by operation of adjusting screw 71. It can be adjusted horizontally at the bottom by means of screw 73 and during this adjustment, the sub-assembly may pivot around the axis of upper adjusting bolt 44. Following precise adjustment, the sub-assembly can be locked securely in the proper position.

Figure 2:
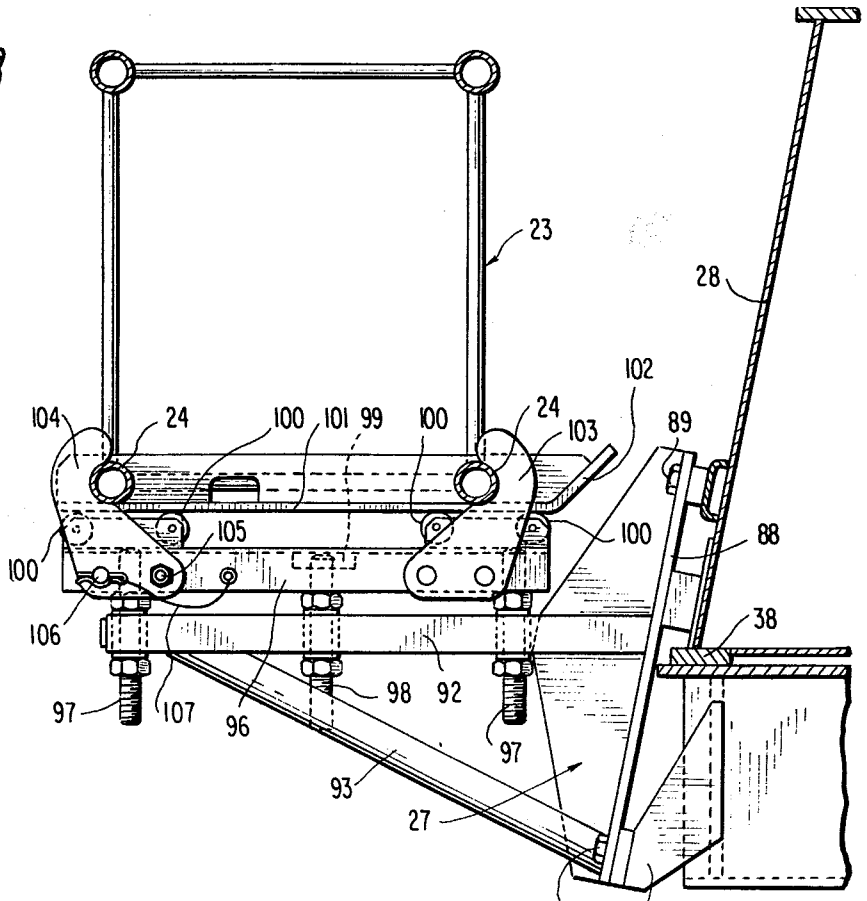
FIG. 2 is an enlarged fragmentary vertical section taken approximately on line 2—2 of FIG. 1 and showing the jib fully engaged with the rear mounting assembly of the boom following continued movement from its position in FIG. 1 and release of its nose assembly pivotal connection.
Figure 3:
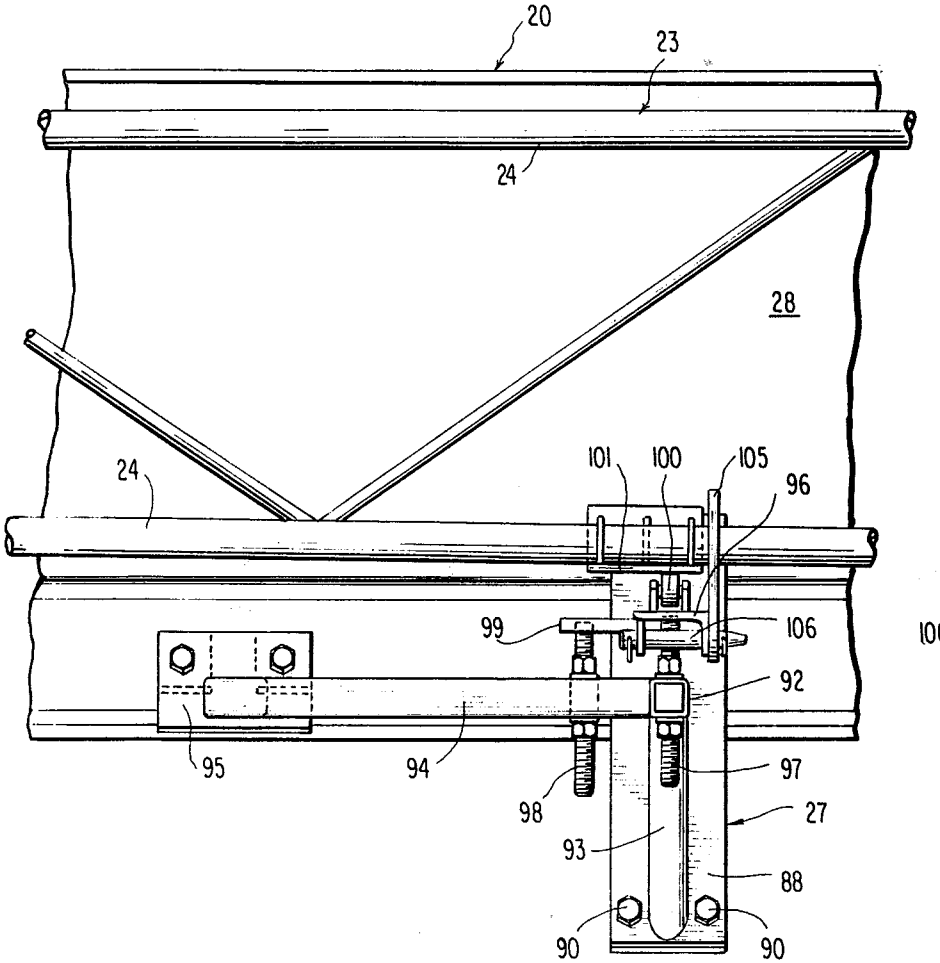
FIG. 3 is a fragmentary side elevation of the components shown in FIG. 2.

Rear mounting assembly 27 which is generally conventional is shown particularly in FIGS. 2 and 3 and comprises a bracket 88 secured by upper bolts 89 to the adjacent boom section 28 and by lower bolts 90 to a depending support structure 91 on the boom section.

The bracket 88 extends below the level of boom section 28 and has a horizontal arm 92 extending outwardly therefrom supported by a diagonal brace 93 connected to the bottom of bracket 88. A further upper diagonal brace 94 extends from one side of the arm 92 to an anchor plate 95 fixed on the boom section 28, as shown.

Above the fixed arm 92 is a horizontal angle bar 96 which is supported near its ends by vertically adjustable and lockable screw shafts 97 engaged with the arm 92. An intermediate adjustable screw shaft 98 further supports an extension 99 of the angle bar 96 whereby the latter can be raised and lowered and leveled, and also solidly locked in a proper position.

Pairs of guide and support rollers 100 are carried by opposite ends of the bar 96 to form a support bed for the middle part of swing-around jib 23 when the latter is stowed. The jib has a sled member 101 fixed to its lower side including a leading upturned plate 102 to facilitate passage of the sled onto and across the roller bed when the jib 23 is stowed. A fixed stop element 103 on the inner end portion of angle bar 96 engages and arrests the movement of the interior lower strut 24 as the jib is stowed. An opposing movable outer stop and retainer 104 pivoted at 105 to the bar 96 can be swung into engagement with the outer lower strut 24 of the stowed jib and locked by a removable locking pin 106, which pin is connected to the bar 96 by a suitable tether 107. The locking pin 106 is installed whenever the mobile crane is traveling on a roadway with the swing-around jib stowed on its side. It can be installed at other times when the jib is stowed.

In addition to the sled 101, the jib 23 at its lower side, FIGS. 4 and 5, has an arcuate guidance or swivel plate 108 welded to the top of interior lower strut 24 and this plate slidably and rotationally engages the cylindrical wall of tube 40 near the bottom of the latter. A spherically curved bearing plate 109 adapted to smoothly ride on ramp plate 63 is welded to the bottom of the strut 24. When the jib is being swung toward its side stowed position, FIG. 1, and first engages the forward mounting assembly 26 and the safety latch 51, the plate 108 makes contact with the tube 40. When the pivot element 25 is removed to disconnect the jib from nose assembly 21 in the same general mode of operation described in U.S. Pat. No. 3,785,505, and the jib is swung to its fully stowed position in full engagement with the rear mounting assembly 27, the swivel plate 108 and bearing plate 109 assist in the proper transitional rotation and guidance of the jib.

To avoid interference with mounting bracket 35, the interior lower end portion of tube 40 is cut away on a steep angle and reinforced in this region by a welded plate 110.

Figure 9:
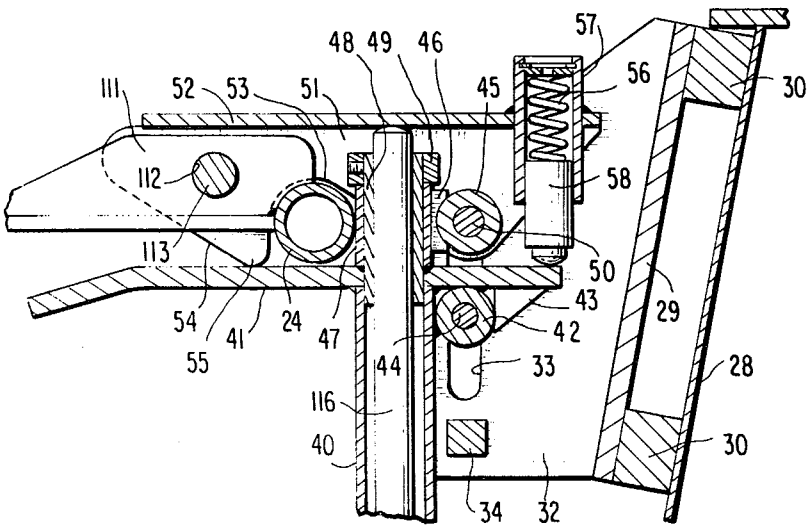
FIG. 9 is a vertical section taken on line 9—9 of FIG. 7.

On its upper side directly above the plate 108, upper interior strut 24 carries a locking plate 111 welded thereto having a locking aperture 112 adapted to receive a removable locking pin 113 at proper times as when the crane is in transit with the jib stowed on it. As shown in FIGS. 4 and 9, the locking plate 111 enters between the two side walls 51 of the safety latch as the latch is engaging the upper strut 24 during the stowing of the jib.

An important feature of the invention is its capability of releasing safety latch 51 from ground level by use of the lever 83 following withdrawal of the lever locking pin 85. To facilitate this, the end portion of the lever 83 away from its handle is connected by a pivot element 114 with a bifurcated lower end 115 of a vertically shiftable latch release rod 116 which extends upwardly through the tube 40. The upper end of the release rod 116 is preferably rounded, as shown, and engages against the top wall 52 of the safety latch to lift the latch by swinging it upwardly on the axis of its pivot 50 at proper times under influence of the release lever 83, whose handle is pulled downwardly. FIG. 6 of the drawings shows the release rod 16 and safety latch above it elevated to the release position corresponding to the broken line position of the latch in FIG. 4. FIG. 4 in full lines shows the latch in its down active position to lock the upper strut 24 to front mounting assembly 26. The latch can only be released by the lever 83 if locking pins 113 and 85 are withdrawn. If locking pin 85 is installed, the safety latch cannot be released even when the pin 113 is not in place. The release rod 116 and the lever 83 act against the strong biasing spring 56 for the latch, and when the lever 83 is released, the parts will return to their normal positions shown in FIG. 4.

OPERATION

During movement of the swing-around jib 23 from its use position to its side stowed position, generally as described in U.S. Pat. No. 3,785,505, the base of the jib remains pivotally connected at 25 to one side of the boom nose assembly 21 until the upper strut 24 is fully engaged with safety latch 51, as shown in FIGS. 4 and 9. This latch engagement will take place when the jib is at the position shown in FIG. 1 and the latch is in its biased angled position shown in FIG. 7. The latch will subsequently rotate into a parallel position with the ramp plate 41 against the force of spring 59 during final movement of the jib into engagement with the rear mounting assembly 27.

As soon as the safety latch is engaged and the lower strut 24 is also fully on the lower ramp plate 63, FIG. 4, the nose assembly pivot 25 can be disconnected with complete safety, without depending on a human operator to install a locking pin or other device to retain the upper strut 24, as in the prior art.

When the pivot 25 is disconnected, final swinging of the jib into engagement with rear mounting assembly 27 can take place to bring about the condition shown in FIG. 2 which has already been described. The jib is now stowed and safely supported by the two assemblies 26 and 27, and at no time during the operation is the jib without safe support so that it could fall. This is due to the provision of the automatic safety latch 51. Therefore, the main objective of increased safety in a side stowable jib is realized by a relatively simple, practical and sturdy mechanism which is fully adjustable and convenient to operate.

When it is necessary to deploy the jib 23 for use from its side stowed position, the crane boom 20 is depressed to a near ground level position and the pivoted retainer or stop 104 is released by removal of the locking pin 106. At this time, the pivot 25 remains disconnected. The jib is swung away from engagement with the rear mounting assembly 27 so that the base of the jib approaches the nose assembly 21 as depicted in FIG. 1. During this relatively short swinging movement of the jib, it is safely and solidly supported by the front mounting assembly 26 and the safety latch 51 remains engaged with the strut 24. The safety latch returns to the angled position of FIG. 7 during this transition movement of the jib and when it reaches this position, the pivot 25 is reconnected between the base of the jib and the crane boom nose assembly. When this has been accomplished, the safety latch lock pin 113, if in place, is removed, and the lower pin 66 is also removed at this time, and an operator at ground level then pulls downwardly on the safety latch release lever 83, after first pulling the lever lock pin 85, if this pin is in place. The pulling of the lever 83 elevates the latch release rod 116 to its position shown in FIG. 6 and also shown in broken lines in FIG. 4, forcing the latch 51 to its raised release position clear of the upper strut 24 of the jib, the biasing spring 56 yielding at this time.

The remaining forward swing-around movement of the jib can now take place and the jib will separate entirely from front mounting assembly 26. The base of the jib is then connected with the other side of nose assembly 21 in the manner set forth in U.S. Pat. No. 3,785,505.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a crane having a boom equipped with a side stowable jib, spaced forward and rear mounting assemblies for the jib in its stowed position on one side of the boom, a releasable connection for the base of the jib with the nose of the boom in the use position of the jib including a pivot for the jib enabling it to be swung around from the use position to the stowed position, the improvement comprising an automatically engaging safety latch having a biased pivotal mounting on said forward mounting assembly to squarely engage the jib and retain it safely in supported relationship with the forward mounting assembly during a swinging movement interval of the jib when its base is separated from the nose of the boom and prior to engagement of the jib with the rear mounting assembly, whereby the latch is able to turn with the jib during final swinging of the jib into supportive engagement with said rear mounting assembly.

2. In a crane as defined in claim 1, and a mechanical means to release said safety latch on the forward mounting assembly.

3. In a crane as defined in claim 2, and said mechanical means including a manual release lever operatively connected with the latch.

4. In a crane as defined in claim 3, and said latch comprising a spring-urged latch near the top of the forward mounting assembly biased toward an active latching position and adapted to cammingly engage a corner strut of the jib as the latter is swung toward the stowed position, said manual release lever being pivotally mounted on the lower end portion of the forward mounting assembly, and a latch release element connected between said lever and said latch operable to move the latch to a release position against the spring force biasing the latch.

5. In a crane as defined in claim 4, and the latch release element comprising a rod connected with said lever and having an upper end slidably engaging said latch to lift the latch when the rod is displaced upwardly by the lever, and a guide member for said rod on the forward mounting assembly substantially normal to the axis of the boom.

6. In a crane as defined in claim 5, and said latch having a rotational connection around the axis of said rod at right angles to a pivot axis of the latch on the forward mounting assembly.

7. In a crane as defined in claim 5, and the forward mounting assembly comprising a pair of spaced mounting brackets fixed to said one side of the boom, and means adjustably connecting said guide member and rod and said lever to one of said brackets for adjustment as a unit on two orthogonal axes, and separate means adjustably connecting said rod and guide member, and said spring-urged latch to the other bracket for adjustment pivotally and on one orthogonal axis.

8. In a crane as defined in claim 1, and the latch having a second biased pivotal mounting across the axis of the first-named pivotal mounting, whereby the latch can pivot on two axes simultaneously.

9. A safety mounting assembly for a side stowable jib on a crane boom, said mounting assembly comprising bracket means fixedly mounted on one side of the crane boom, a safety latch and latch release mechanism connected as an assembled unit, the safety latch disposed near the top of said assembled unit and having a dual cross axis pivotal connection therewith, an underlying coacting ramp plate on the assembled unit for supporting a jib strut as the latter swings into engagement with the latch, a first spring means biasing said latch toward an active latch-engaging position relative to said ramp plate, a second spring means biasing said latch toward an angled position relative to said ramp plate whereby the latch can be engaged squarely by the strut of a jib moving toward a stowed position, and means adjustably securing the assembled unit to the bracket means for adjustment of two orthogonal axes and being adapted to lock the unit securely in a selected adjusted position.

10. A safety mounting assembly as defined in claim 9, and the assembled unit including a lower jib strut supporting and locking means, a latch release lever pivotally connected with the lower end of said assembled unit, a rising latch release member connected with and operated by the lever and having an upper end contacting said latch, and a member enclosing and guiding the latch release member and extending between and being rigidly connected with opposite end portions of said unit.

11. A safety mounting assembly as defined in claim 10, and one axis of said dual cross axis pivot of the latch being across the axis of the latch release member and the other axis of said dual axis pivot being coaxial with the latch release member.

12. A safety mounting assembly as defined in claim 11, and said other axis being defined by a rotational sleeve surrounding the latch release member, and a support for an element defining said one axis of the dual axis pivot attached to said sleeve.

13. In a crane having a boom equipped with a side stowable jib, spaced forward and rear mounting assemblies for the jib in its stowed position on one side of the boom, a releasable connection for the base of the jib with the nose of the boom in the use position of the jib including a pivot for the jib enabling it to be swung around from the use position to the stowed position, the improvement comprising an automatically engaging safety latch, pivot means having an axis extending transverse of the one side of the boom rotationally connecting said safety latch on said forward mounting assembly, said latch pivotally connected to said pivot means on a pivot axis at right angles to the axis of said pivot means, whereby the latch pivots on two axes simultaneously to engage the jib and retain it safely in supported relationship with the forward mounting assembly during a movement interval of the jib when its base is separated from the nose of the boom and prior to engagement of the jib with the rear mounting assembly.

* * * * *